US011305450B2

(12) United States Patent
Hauser

(10) Patent No.: US 11,305,450 B2
(45) Date of Patent: Apr. 19, 2022

(54) SLICER AND PUSHER

(71) Applicant: Progressive International Corporation, Kent, WA (US)

(72) Inventor: Lawrence Hauser, Auburn, WA (US)

(73) Assignee: Progressive International Corporation, Kent, WA (US)

( * ) Notice: Subject to any disclaimer, the term of this patent is extended or adjusted under 35 U.S.C. 154(b) by 78 days.

(21) Appl. No.: 16/802,237

(22) Filed: Feb. 26, 2020

(65) Prior Publication Data

US 2020/0276725 A1 Sep. 3, 2020

Related U.S. Application Data

(60) Provisional application No. 62/812,154, filed on Feb. 28, 2019.

(51) Int. Cl.
*B26D 7/26* (2006.01)
*B26D 3/28* (2006.01)

(52) U.S. Cl.
CPC ..... *B26D 7/2628* (2013.01); *B26D 3/283* (2013.01); *B26D 3/28* (2013.01); *B26D 7/26* (2013.01); *B26D 2003/286* (2013.01); *B26D 2003/287* (2013.01)

(58) Field of Classification Search
CPC ..... B26D 7/2628; B26D 7/26; B26D 3/28; B26D 3/283; B26D 2003/286–287; A47J 44/00; A47J 43/00; A47J 43/255; A47J 37/12; A47J 36/20; A47F 10/06
USPC .... 83/651, 698.71, 858, 697, 564, 856, 247, 83/932, 425.3, 431, 717, 441.1, 435.15, 83/437.7, 698.1, 954, 92; 269/20–22, 43, 269/16, 136–138; 30/123.5; 241/89.4; 254/100, 102; 425/298, 111, 236, 299, 425/318, 440; 429/142, 217, 63, 74, 92, 429/97; 99/415
See application file for complete search history.

(56) References Cited

U.S. PATENT DOCUMENTS

| | | | | |
|---|---|---|---|---|
| 4,211,404 A * | 7/1980 | Blowsky | A63B 21/00043 482/128 | |
| 6,394,005 B1 | 5/2002 | Isensee | | |
| 6,732,622 B2 | 5/2004 | Vincent | | |
| 7,107,890 B2 * | 9/2006 | Vincent | A47J 43/25 30/278 | |
| 7,331,776 B2 * | 2/2008 | Errera | A21C 11/02 249/142 | |
| 8,438,961 B2 | 5/2013 | Repac | | |

(Continued)

FOREIGN PATENT DOCUMENTS

| | | | |
|---|---|---|---|
| FR | 2853850 A1 * | 10/2004 | A47J 43/25 |
| FR | 2853850 A1 | 10/2004 | |

*Primary Examiner* — Nhat Chieu Q Do
(74) *Attorney, Agent, or Firm* — Lowe Graham Jones PLLC

(57) ABSTRACT

A pusher for use with a mandoline slicer includes a cap having an upper and a lower end, the cap defining an interior space. A lower plate is attached to a pillar, which is attached to a telescoping post. The pillar and telescoping post are telescopically moveable with respect to one another along the central axis and trained for movement by a guide within the cap. Stops are provided along the guide to restrict the length of travel of the telescoping post and pillar. A spring is connected to the cap and the lower plate to urge the lower plate away from the cap in a direction from the upper end toward the lower end.

17 Claims, 6 Drawing Sheets

(56) References Cited

U.S. PATENT DOCUMENTS

| | | | | |
|---|---|---|---|---|
| 9,038,517 | B2 | 5/2015 | Lucas | |
| 10,160,133 | B2 | 12/2018 | Hauser | |
| 2006/0075870 | A1 | 4/2006 | Wangler | |
| 2006/0254431 | A1* | 11/2006 | Mariano | A47J 36/20 99/415 |
| 2009/0255391 | A1 | 10/2009 | Hood | |
| 2018/0262603 | A1* | 9/2018 | Richter | H04B 1/3888 |

* cited by examiner

SLICER AND PUSHER

PRIORITY CLAIM

This application claims the benefit of prior U.S. provisional application Ser. No. 62/812,154, filed. Feb. 28, 2019, the contents of which are incorporated by reference.

BACKGROUND OF THE INVENTION

A mandoline slicer commonly includes a hand guard or pusher that is configured to slide along a ramp of the slicer toward a slicing blade. The ramp may be formed in two sections, including a proximal first section and a distal second section, in which a main slicing blade is positioned between the first section and the second section. A gap is defined between the two ramp portions to allow the two portions to be adjusted upward or downward with respect to one another. For example, the first section may be adjustable to varying heights below the level of the slicing blade in order to vary the thickness of the slices produced when the food item passes over the blade.

A pusher or hand guard is commonly used with such slicers in order to aid in pushing a food item along the slicer from the first section (or platen), across the blade, and down the second section (or runout plate). In some cases, the hand guard may optionally be formed with a wide flange surrounding a generally cylindrical upper grip or cap. A lower plate with teeth, or otherwise having a surface that can engage the food item, is provided on the bottom or a lower surface of the cap. In some cases, the lower plate is capable of retracting upwardly within the cap to accommodate larger food items.

The pusher or hand guard may include a central post connected to the lower plate, in which the central post extends through the cap so that a person may press downward on the post to force the lower plate downward, thereby pushing the food item against the mandoline. This hand-operated process may require a constant force by the user against the hand guard and the post. In one case, others have incorporated a spring into the hand guard to aid in the force of the plate against the food item. For example, in U.S. Pat. No. 6,732,632, a spring surrounds the post and is trained between the top of the hand guard and the lower plate to provide such a downward force against the plate. The post, however, still extends through the top of the hand guard cap and is intended to require a user to press against the post. This can be awkward and difficult, particularly at the initial use of the hand guard as the post extends significantly above the cap. Some users may lack the dexterity or the length or strength of fingers or hands to easily manipulate the cap and the post extending through it.

SUMMARY OF THE INVENTION

A slicer and pusher is intended for use with a mandoline slicer in which the slicer includes an upper ramp and a lower ramp with a slicing blade positioned between the upper ramp and the lower ramp. The pusher is operable to push a food item from the upper ramp to the lower ramp, whereby the food item is sliced by the slicing blade. Preferably, the pusher has a cap having an upper and a lower end, the cap defining an interior space.

A lower plate is attached to a pillar (which may be tubular), and preferably the lower plate is circular with a number of spikes for engaging a food item. The pillar defines a central axis, the pillar further being attached to a telescoping post (which may be tubular) wherein the pillar and telescoping post are telescopically moveable with respect to one another along the central axis.

In some versions, a guide is defined within the interior space. The combined pillar and telescoping post are mounted to the guide for movement of the pillar and telescoping post with respect to the guide along the central axis.

Preferably, the spring has a first end connected to the cap and a second end connected to the lower plate, the spring urging the lower plate away from the cap in a direction from the upper end toward the lower end.

In some examples, the upper end of the cap further comprises a central opening positioned about the central axis, the cap further having an upper abutment providing a stop to limit upward movement of the telescoping tube.

The guide may have a lower abutment providing a stop to limit downward movement of the telescoping tube.

Likewise, the upper abutment may positioned to prevent upward movement of the telescoping tube beyond the upper end of the cap.

In some versions, the telescoping post is configured as a tube, and in some examples the telescoping tube surrounds the pillar.

In some versions, the guide defines an interior channel and the telescoping post or tube and pillar are received within the interior channel.

Preferably, the telescoping tube further includes a lower seat configured to limit movement of the pillar.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
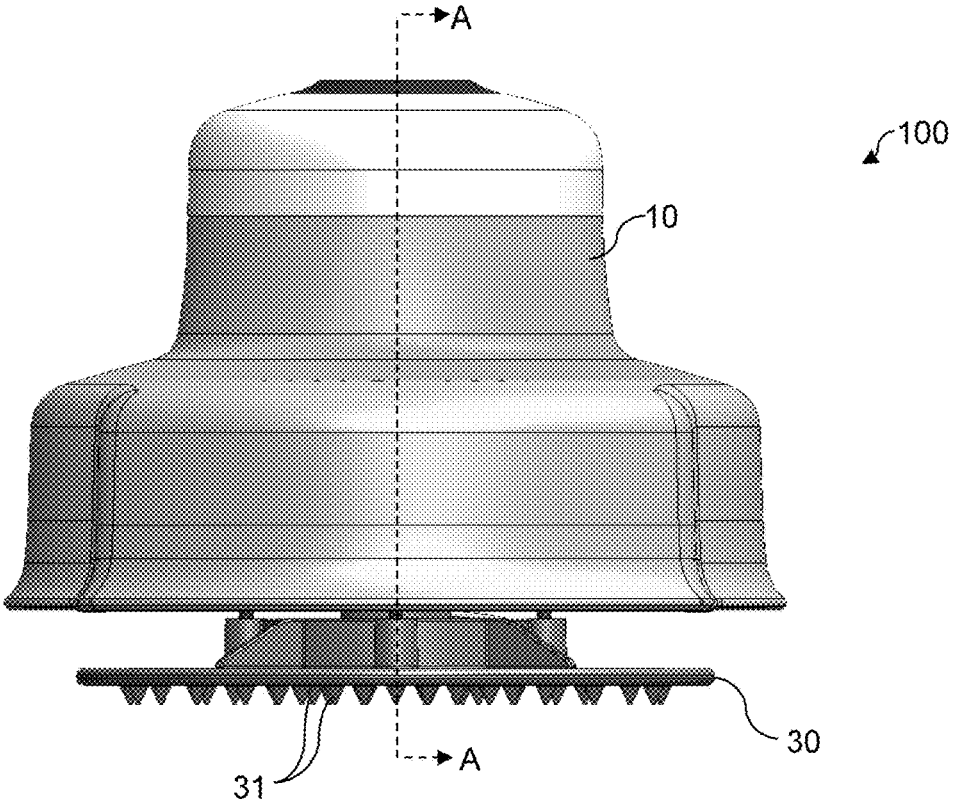
FIG. 1 is a front elevational view of a preferred food processing pusher.

A preferred food processing pusher 100 is shown in a front elevational view in FIG. 1. In general, the food processing pusher is best used together with a mandoline-type slicer, such as the exemplary slicer 200 shown in FIG. 10. As shown, the pusher 100 includes a cap 10 and a lower plate 30. The lower plate is formed with a plurality of teeth 31 which can engage a food item to retain the lower surface of the lower plate against the food item.

Figure 2:
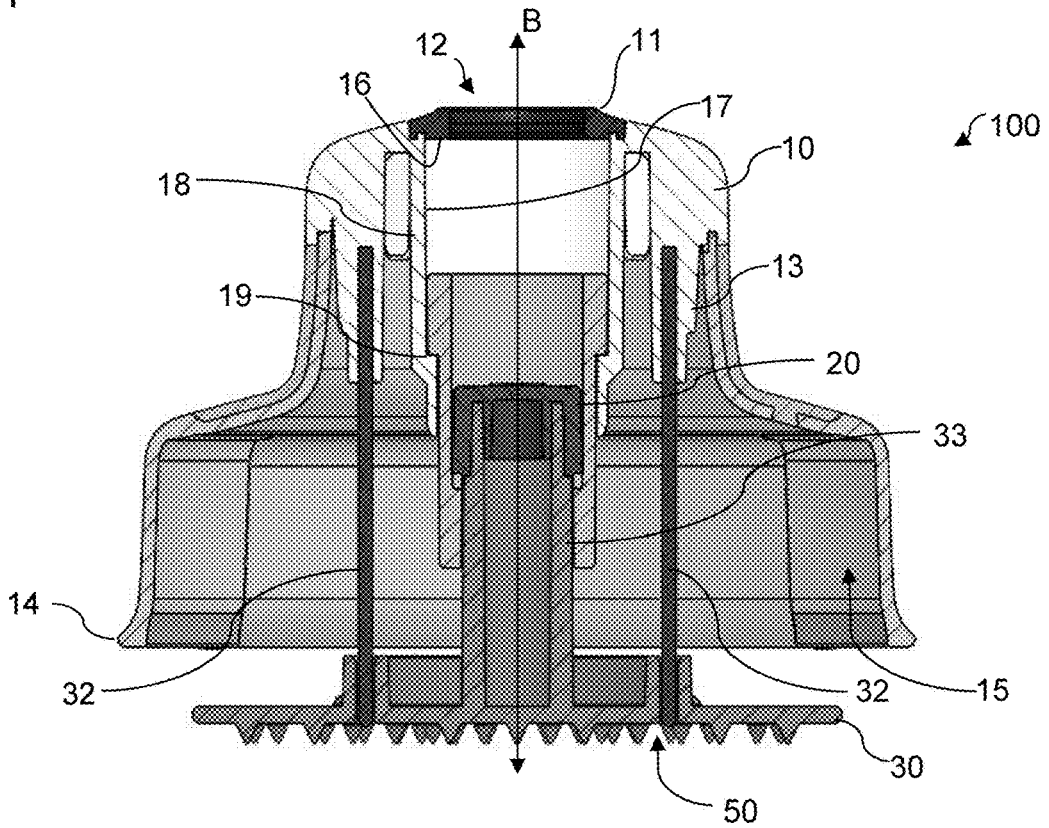
FIG. 2 is a sectional view of the food processing pusher of FIG. 1, taken along sectional plane A-A from FIG. 1. A spring is omitted for ease of illustration.

FIG. 2 shows the pusher of FIG. 1, in a sectional view taken along sectional plane A-A from FIG. 1. The cap 10 includes an upper end which may include a central opening 12, and a lower end terminating in a lower rim 14. The upper end may include an annular ring 11 which seats at the top of the upper end and which defines the interior mouth of the central opening 12. A generally hollow interior space 15 is provided inside the cap, between the upper end (at the central opening 12) and the lower end (at the lower rim 14). The interior of the cap may include one or more receptacles 13 for mounting one or more spikes 32 whiCh then extend downwardly from an upper interior portion of the cap toward (and preferably through) the lower end. In the preferred example, four such receptacles and spikes are provided. The lower ends of the spikes extend through openings 50 formed in the lower plate 30, so that the lower plate can slide axially along a path defined by the spikes, which are parallel to one another.

The pusher is configured with a central post assembly or structure that is designed to allow the lower plate to travel telescopically upwardly and downwardly, along a central axis B (see FIG. 2) which is parallel to the spikes. A preferred version of the post is shown separately in FIGS. 5 and 6, and in an exploded view in FIG. 9. In sectional views of FIGS. 2 and 4, the lower plate is extended downwardly, while in the sectional view of FIG. 3 it is retracted into the interior of the cap.

As best seen in FIG. 2, the upper end of the central opening 12, which as noted above may be defined by an annular ring 11 surrounding the central opening 12, includes a lower surface 16 which extends radially inwardly from an interior sidewall 17 of a cylindrical guide 18 defining a channel and positioned inside the cap 10 and extending along the vertical axis B. Preferably the cylindrical guide is integrally formed with the cap. The annular ring may also be integrally formed with the cap (or with an upper portion of the cap), or alternatively may be separately attached to the cap, allowing it to be made from different materials if desired. The lower surface 16 of the rim 11 provides an upper abutment to limit the path of travel of the telescoping post, as described below. The cylindrical guide 18 further includes, at a lower end, an inwardly-directed seat 19, which serves as a lower limit to the path of travel of the telescoping post. Thus, a portion of the telescoping post is shown in contact with the lower seat 19 in the position of FIG. 2, in which the telescoping post is fully extended and the lower plate 30 is at its lowest position. A portion of the telescoping post is in contact with the lower surface 16 of the rim 11 in the position of FIG. 3, in which the telescoping post is fully retracted and the lower plate 30 is withdrawn in to the interior space 15 of the cap. In the retracted position of FIG. 3, a portion of the lower plate may also be in contact with an interior surface 52 of the cap, further limiting the upward path of travel of the lower plate and the telescoping post.

Figure 3:
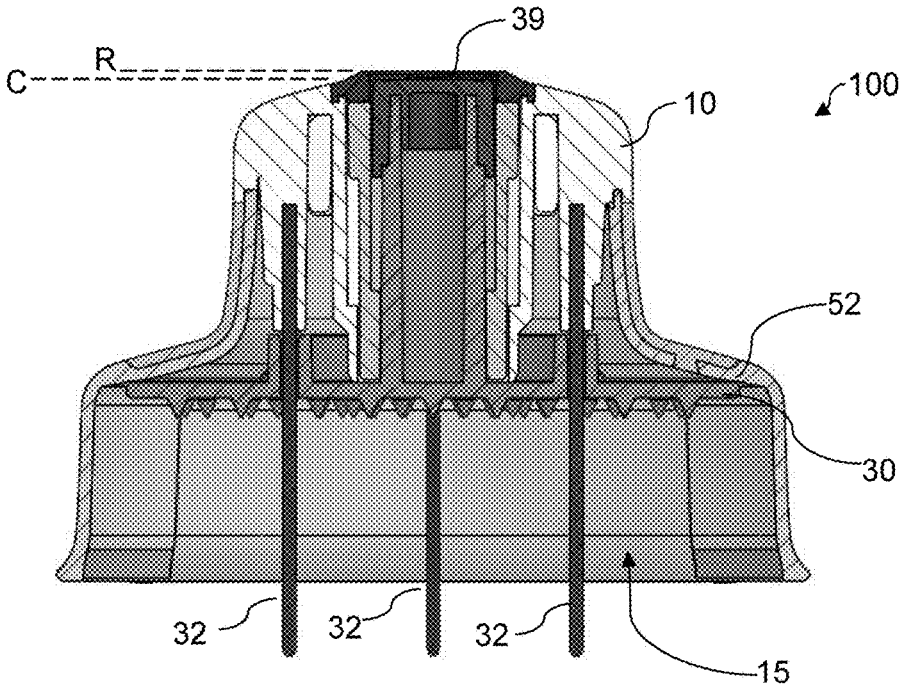
FIG. 3 is a sectional view of the food processing pusher of FIG. 1, taken along sectional plane A-A from FIG. 1, and shown with a lower plate in a raised position. As with FIG. 2, a spring is omitted for ease of illustration.
Figure 4:
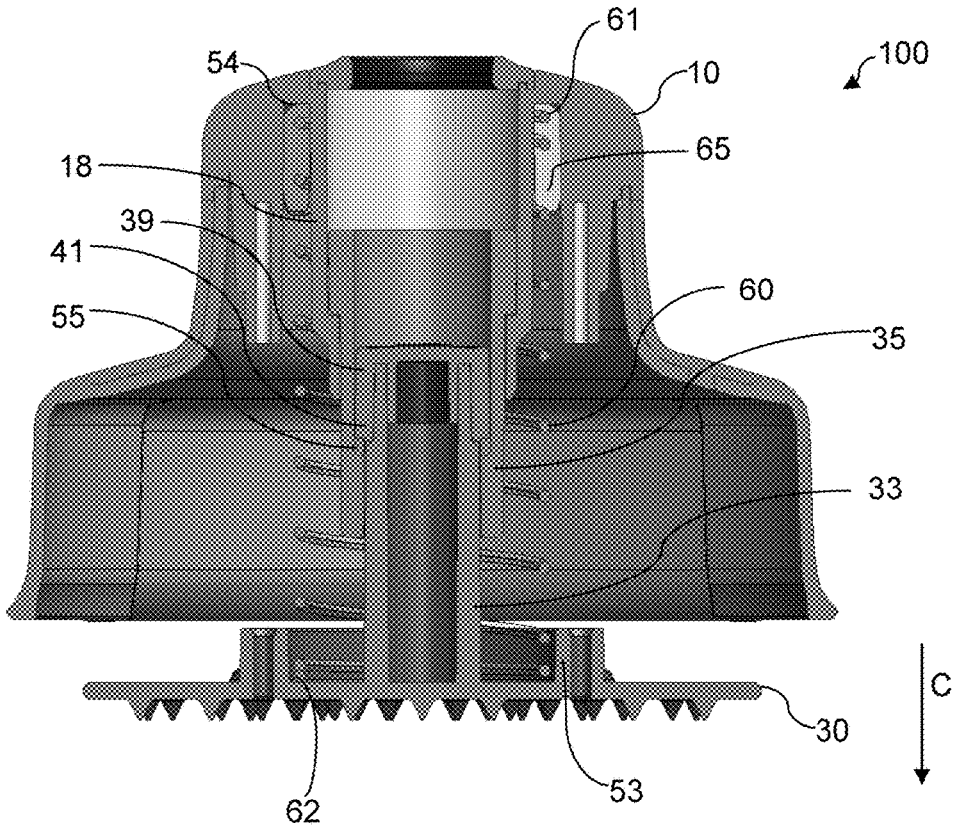
FIG. 4 is a sectional view of the food processing pusher of FIG. 1, taken along sectional plane A-A from FIG. 1. In this illustration, a spring is included but spikes are omitted for ease of illustration.

A spring 60 is omitted from the views of FIGS. 2 and 3 for ease of illustration, but is shown in the sectional view of FIG. 4. The spring 60 is illustrated as a coil spring surrounding the cylindrical guide 18, and is positioned between the upper end of the cap 10 and the lower plate 30, and configured to urge the lower plate downwardly in the direction of arrow C in FIG. 4, away from the cap. A first end 61 of the coil spring 60 is retained within an annular cavity 65 formed about the outside of the cylindrical guide 18 and abuts an upper surface within the annular cavity, so that the spring surrounds the cylindrical guide. The spring's abutment of the interior upper surface of the cap 10 limits upward travel of the spring and provides a surface against which the spring may be compressed.

The opposite second end 62 of the spring is trained about the outside of a pillar, which is illustrated as a vertical central pillar 33 extending upwardly from the lower plate 30. A cylindrical retaining wall 53 is provided radially outwardly from the pillar, so that the coil spring is retained within the space between the pillar and the retaining wall. In this manner, the spring is trapped between an interior surface of the upper end of the cap and an upper surface of the lower plate to urge the plate away from the cap.

Figure 9:
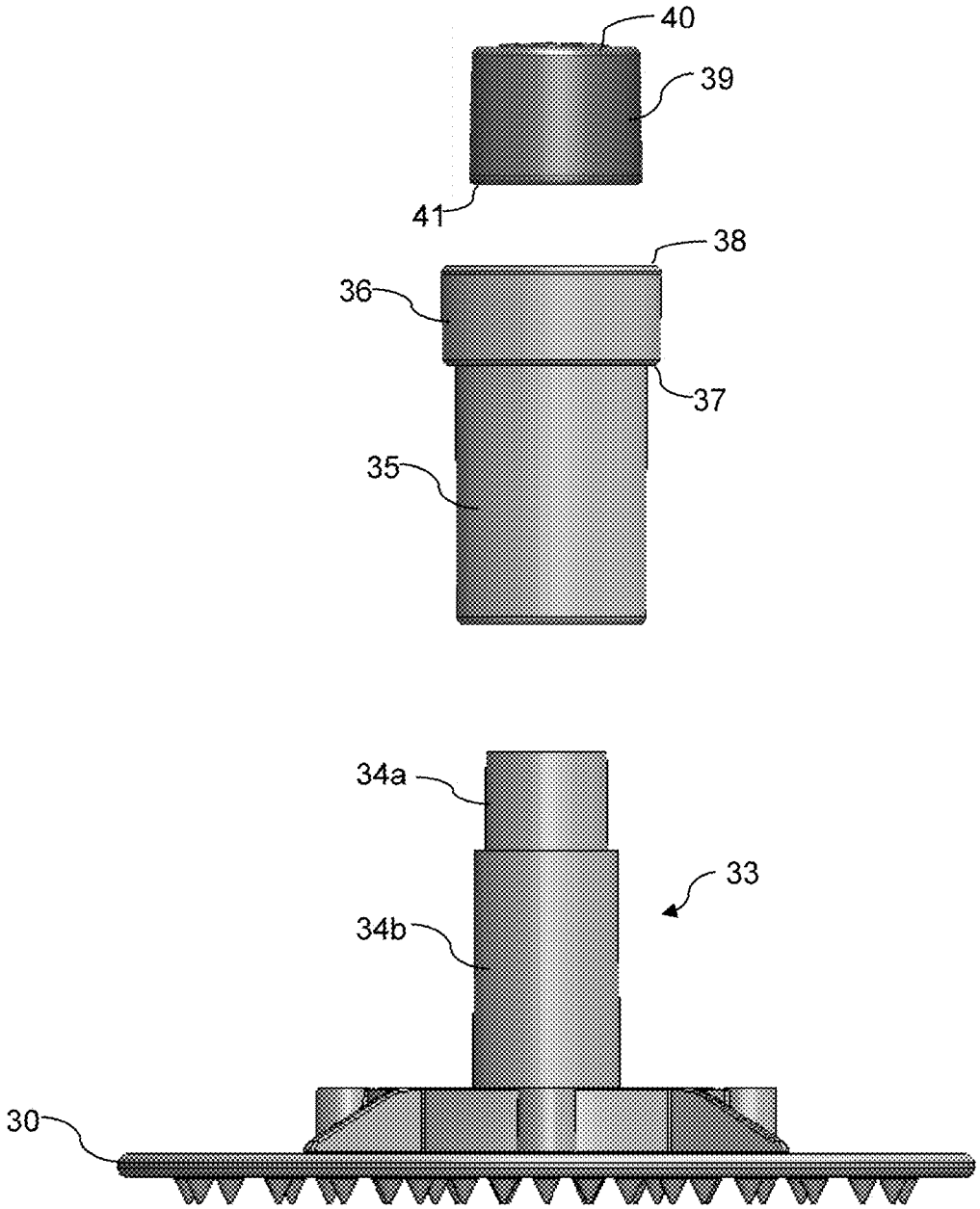
FIG. 9 is a front elevational exploded view of a central post assembly.

As best seen in the exploded view of FIG. 9, the central pillar 33 preferably is formed with a cylindrical shape, and in one version an upper end terminates in an end section 34*a* having a smaller diameter than that of the lower end 34*b* of the central pillar. The outer diameter of the end section is sized and shaped to receive an end cap 39, having a top surface 40.

A telescoping post, which may be a hollow post such as a tube 35, is sized and shaped to surround the central pillar 33, and therefore it preferably includes a cylindrical interior having a diameter greater than that of the outer diameter of the central pillar. An interior surface of the telescoping tube 35 includes an inwardly-directed seat or lower abutment 55 (see FIG. 4), which is sized and arranged to abut the lower end 41 of the end cap 39 when the telescoping post is fully extended, such as in the position of FIG. 4.

Figure 5:
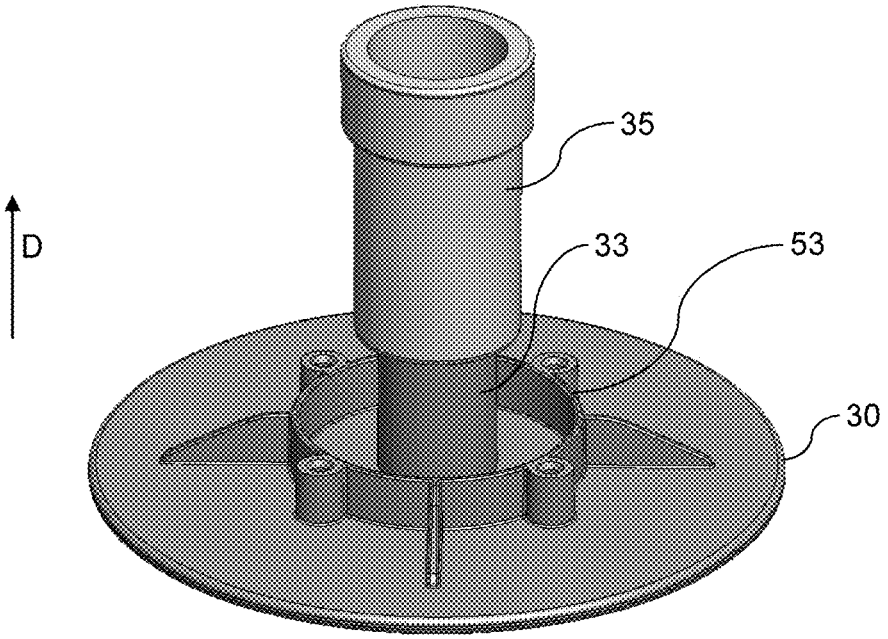
FIG. 5 is a top perspective view of a preferred lower plate and pillar assembly, shown in an extended position.
Figure 6:
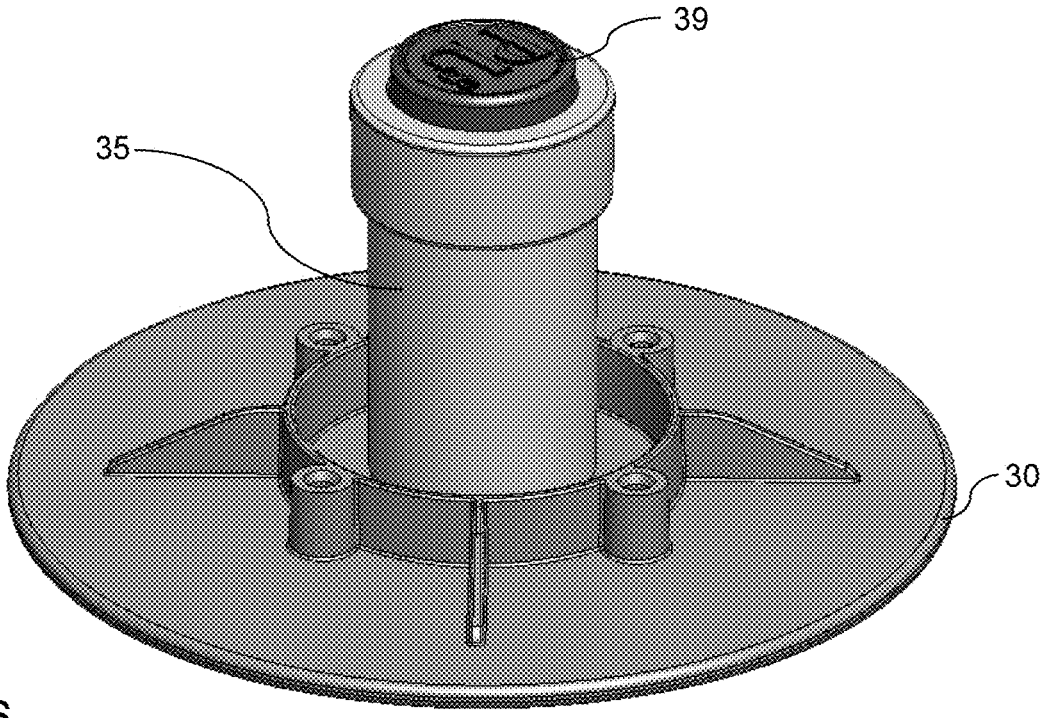
FIG. 6 is a top perspective view of the lower plate and pillar assembly of FIG. 5, shown in a retracted position.

FIGS. 5 and 6 illustrate the lower plate and pillar assembly, showing it in the extended position (FIG. 5) and retracted position (FIG. 6). In FIG. 5, the telescoping tube 35 is moved upward, in the direction of arrow D, with respect to the lower plate 30. Alternately stated, the lower plate is moved downwardly and away from the telescoping tube 35. In this extended position, a portion of the central pillar 33 is visible beneath the telescoping tube 35. In FIG. 6, the lower plate and pillar assembly is shown in the retracted position and the central pillar is not visible. A small portion of the end cap 39 preferably extends through the telescoping tube 35 when the telescoping tube is fully retracted downwardly (or the lower plate fully retracted upwardly), such as shown in FIG. 6. Likewise, in the position of FIG. 6 the bottom of the telescoping post preferably seats against the upper surface of the lower plate 30.

Figure 7:
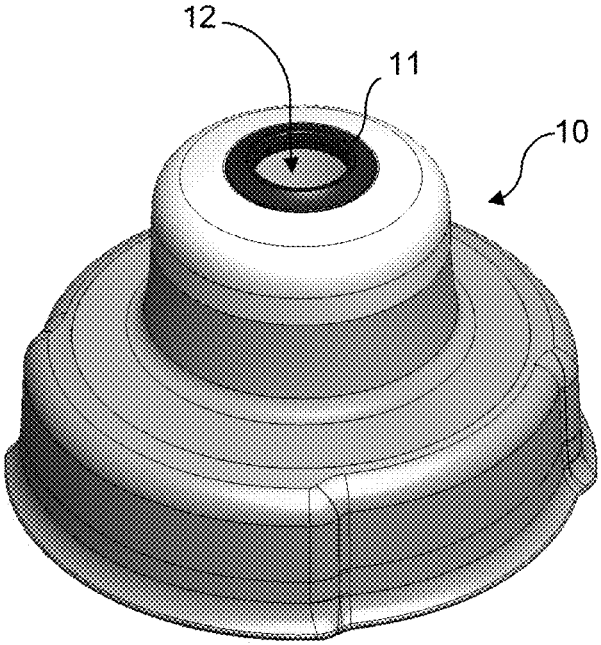
FIG. 7 is a top perspective view of a preferred pusher cap.
Figure 8:
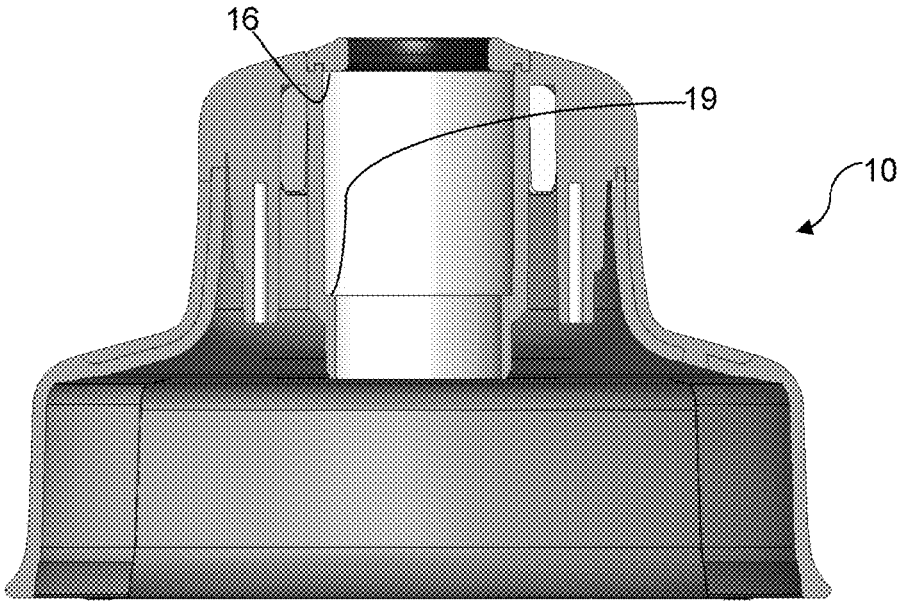
FIG. 8 is a front elevational sectional view of a preferred pusher cap, taken along plane A-A of FIG. 1.

FIG. 7 illustrates the cap 10 by itself, without the interior telescoping post and without the lower plate, such that the other components are not visible. In this perspective view, the upper opening 12 and annular ring 11 are visible. FIG. 8 shows the cap 10 by itself, as in FIG. 7, but in a sectional view taken along section A-A as indicated in FIG. 1.

Figure 10:
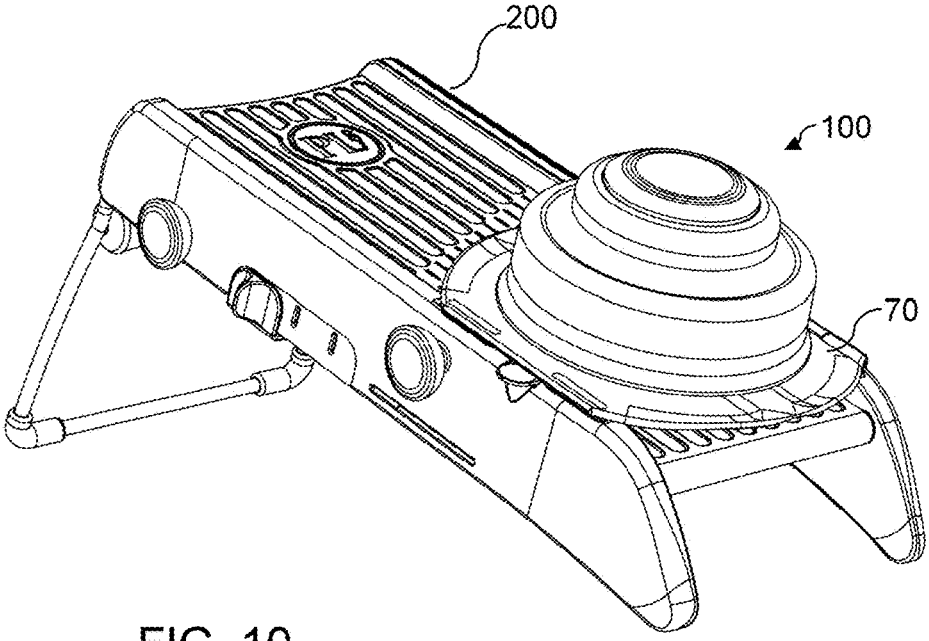
FIG. 10 is a top perspective view of an exemplary mandoline slicer for use with the preferred pusher.

FIG. 10 shows an exemplary mandoline slicer 200, in which a pusher 100 such as the telescoping pusher as described above is mounted. In the version as illustrated in FIG. 10, a wide hand guard 70 is provided about a lower perimeter of the telescoping pusher, though not included in the alternate versions described above.

Figure 11:
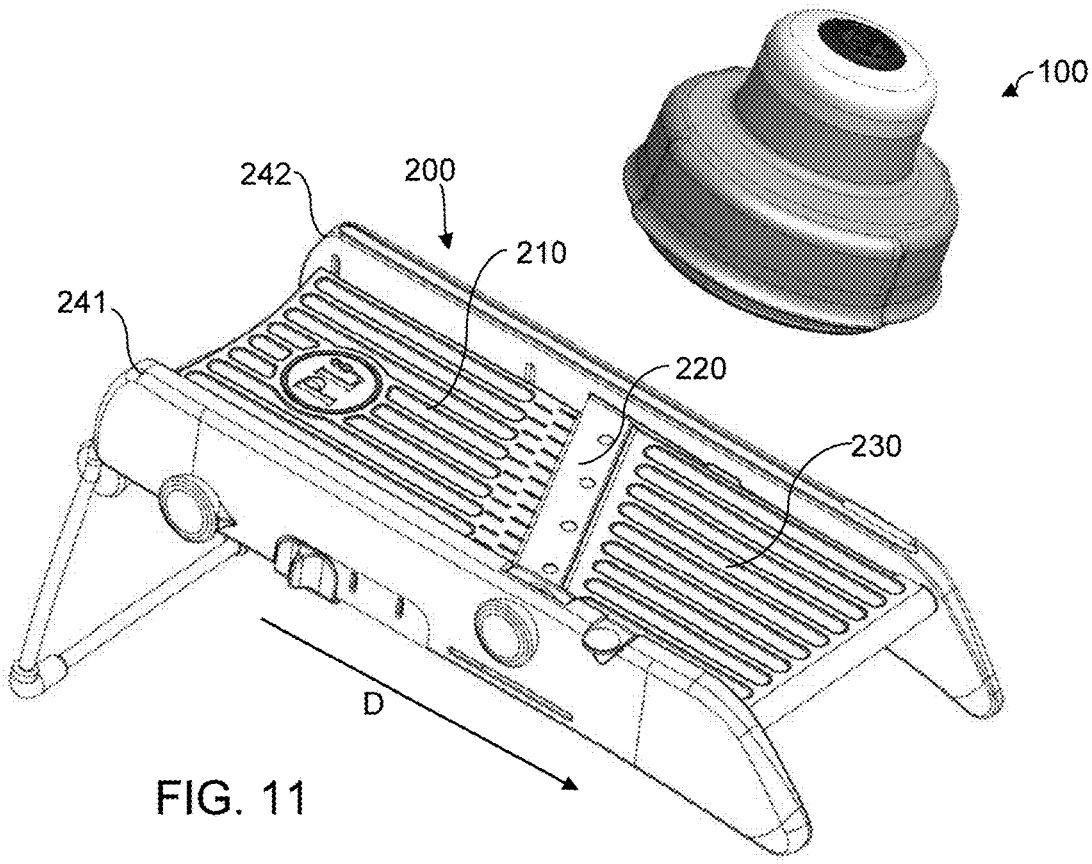
FIG. 11 is a top perspective exploded view of an exemplary mandoline slicer and pusher.

FIG. 11 depicts a mandoline slicer 200, having a pair of opposing frames 241, 242 and a slicing ramp between the frames. The slicing ramp includes an upper ramp 210 and a lower ramp 230, with a slicing blade 220 positioned between the upper and lower ramps. A food item is pushed by the pusher down the ramp from the upper ramp toward the forward ramp in the direction of the arrow D, and is sliced by the blade as it is dragged across the blade.

In operation, a food item can be mounted to the bottom of the lower plate 30, retracting the lower plate into the interior space 15 of the cap 10 such as in the retracted position of FIG. 3 (noting, as above, that the spring is not illustrated for clarity). In this position, the top of the cap 39 extends upwardly to a height C, which is beneath the top of the rim R defined by the top of the cap and the annular ring. As described above, a portion of the telescoping tube abuts the surface 16 at the lower side of the cap opening, to stop the path of travel of the telescoping post and prevent it from traveling through the opening. In one version, the opening 12 is made to be large enough to allow a user to extend a finger into the opening, and to apply further pressure against the cap 39.

As the food item is sliced by the slicer (by reciprocating movement of the pusher 100 and therefore the food item across a blade mounted on the mandoline slicer), the food item becomes smaller and the force of the spring pushes the lower plate 30 downward axially. Eventually, the lower plate reaches the fully extended position along its path of travel, to the position shown in FIG. 4. At this position, the abutment of the cap 39 against an inner surface of the telescoping tube, and an abutment of the telescoping tube against a seat on the interior surface of the guide cylinder, stops the path of travel at the extended position of FIG. 4.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A mandoline slicer, comprising:

a ramp with a slicing blade positioned between the ramp; and a pusher, wherein the pusher comprises:

a cap having an upper and a lower end, the cap defining an interior space;

a lower plate attached to a pillar, the pillar defining a central axis, the pillar further being attached to a telescoping tube wherein the pillar and the telescoping tube are telescopically moveable with respect to one another along the central axis;

a guide defined within the interior space, the pillar and the telescoping tube being mounted to the guide for movement of the pillar and the telescoping tube with respect to the guide along the central axis; and a spring having a first end connected to the cap and a second end connected to the lower plate, the spring urging the lower plate away from the cap in a direction from the upper end toward the lower end, wherein the upper end of the cap further comprises a central opening positioned about the central axis, the cap further having an upper abutment providing a stop to limit upward movement of the telescoping tube, and whereby, the pusher is operable to push a food item along the ramp and across the slicing blade.

2. The mandoline slicer of claim 1, wherein the guide further comprises a lower abutment providing a stop to limit downward movement of the telescoping tube.

3. The mandoline slicer of claim 2, wherein the upper abutment is positioned to prevent upward movement of the telescoping tube beyond the upper end of the cap.

4. The mandoline slicer of claim 1, wherein the telescoping tube surrounds the pillar.

5. The mandoline slicer of claim 4, wherein the guide defines an interior channel and the telescoping tube and pillar are received within the interior channel.

6. The mandoline slicer of claim 5, wherein the telescoping tube further includes a lower seat configured to limit movement of the pillar.

7. The mandoline slicer of claim 6, wherein the spring surrounds the guide.

8. The mandoline slicer of claim 6, wherein the lower plate further includes a retaining wall, the spring being received within the retaining wall.

9. A mandoline slicer, comprising:

a ramp with a slicing blade positioned between the ramp; and a pusher, wherein the pusher comprises:

a cap with an upper end, a lower end, and a central axis extending from the upper end to the lower end, the lower end terminating in a lower rim, the cap defining an interior space;

a guide extending into the interior space from the upper end toward the lower end, the guide having a hollow interior defining a channel, the channel extending to the upper end of the cap to define an upper opening;

a lower plate attached to a pillar, the pillar further being attached to a telescoping post, wherein the pillar and the telescoping post are telescopically moveable with respect to one another along the central axis, the pillar and the telescoping post further being mounted within the channel of the guide for movement of the pillar and the telescoping post with respect to the guide along the central axis; and a spring positioned between the cap and the lower plate, the spring being mounted to urge the lower plate away from the cap in a direction from the upper end toward the lower end, wherein the upper end of the cap further comprises an upper abutment positioned to engage the telescoping post to limit upward movement of the telescoping post, and whereby, the pusher is operable to push a food item along the ramp and across the slicing blade.

10. The mandoline slicer of claim 9, wherein the guide further comprises a lower abutment positioned to engage the telescoping post to limit downward movement of the telescoping post.

11. The mandoline slicer of claim 9, wherein the upper abutment is positioned to prevent upward movement of the telescoping post beyond the upper end of the cap.

12. The mandoline slicer of claim 9, wherein the telescoping post is configured as a telescoping tube, and further wherein the telescoping tube surrounds the pillar.

13. The mandoline slicer of claim 9, wherein the spring surrounds the guide.

14. A mandoline slicer, comprising:

a ramp with a slicing blade positioned between the ramp; and a pusher, wherein the pusher comprises:

a cap with an upper end, a lower end, and a central axis extending from the upper end to the lower end, the lower end terminating in a lower rim, the cap defining an interior space;

a guide mounted within the cap and extending from the upper end into the interior space, the guide having an open interior defining a channel along the central axis, the channel extending to the upper end of the cap to define an upper opening;

a lower plate attached to a pillar, the pillar further being attached to a telescoping post, the pillar and the telescoping post further being mounted within the channel of the guide for movement of the pillar and the telescoping post with respect to one another and with respect to the guide along the central axis; and the guide further having an upper abutment and a lower abutment, the upper abutment and lower abutment limiting the extent of movement of the pillar and the telescoping post along the central axis; and a spring positioned between the cap and the lower plate, the spring being mounted to urge the lower plate away from the cap in a direction from the upper end toward the lower end, wherein the upper abutment is positioned to prevent upward movement of the telescoping post beyond the upper end of the cap, and whereby, the pusher is operable to push a food item along the ramp and across the slicing blade.

15. The mandoline slicer of claim 14, wherein the telescoping post is configured as a telescoping tube, and further wherein the telescoping tube surrounds the pillar.

16. The mandoline slicer of claim 15, wherein spring surrounds the guide.

17. The mandoline slicer of claim 16, wherein the lower plate further includes a retaining wall, the spring being received within the retaining wall.

* * * * *